United States Patent [19]

Theurer et al.

[11] 4,399,753

[45] Aug. 23, 1983

[54] MOBILE TRACK CORRECTION MACHINE

[75] Inventors: Josef Theurer, Vienna; Johann Pichler, Strassham, both of Austria

[73] Assignee: Franz Plasser Bahnbaumaschinen Industriegesellschaft mbH, Vienna, Austria

[21] Appl. No.: 261,571

[22] Filed: May 7, 1981

[30] Foreign Application Priority Data

Jun. 2, 1980 [AT] Austria ..... 2918/80

[51] Int. Cl.[3] ..... E01B 33/02

[52] U.S. Cl. ..... 104/7 B

[58] Field of Search ..... 104/7 B, 7 R, 8, 12, 104/10, 2

[56] References Cited

U.S. PATENT DOCUMENTS

| | | | |
|---|---|---|---|
| 3,134,339 | 5/1964 | Plasser et al. | 104/7 B |
| 3,832,952 | 9/1974 | Hurni | 104/7 B |
| 4,170,942 | 10/1979 | Theurer . | |
| 4,342,263 | 8/1982 | Hurni | 104/7 B |

FOREIGN PATENT DOCUMENTS

| | | | |
|---|---|---|---|
| 1239343 | 4/1967 | Fed. Rep. of Germany | 104/7 B |
| 243244 | 11/1925 | United Kingdom | 104/8 |
| 1057935 | 2/1967 | United Kingdom . | |

*Primary Examiner*—Bruce H. Stoner, Jr.
*Assistant Examiner*—Donald Hajec
*Attorney, Agent, or Firm*—Kurt Kelman

[57] ABSTRACT

A mobile track tamping, leveling and lining machine comprises a machine frame, a vertically adjustable tool carrier guided along the track, track lining and lifting tools mounted on the carrier and engageable with the track rails, and power drives linking the tool carrier to the machine frame. The power drive includes a lining jack linking the tool carrier to the machine frame and extending substantially vertically above the lining tools and the tool carrier, and a force-transmitting lever extends in a vertical plane and is operable to reciprocate transversely to the track. The lever connects the lining jack to the tool carrier.

10 Claims, 7 Drawing Figures

Fig.1
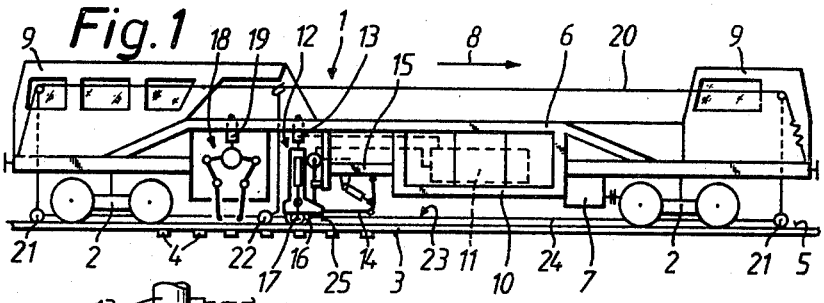
Fig.2
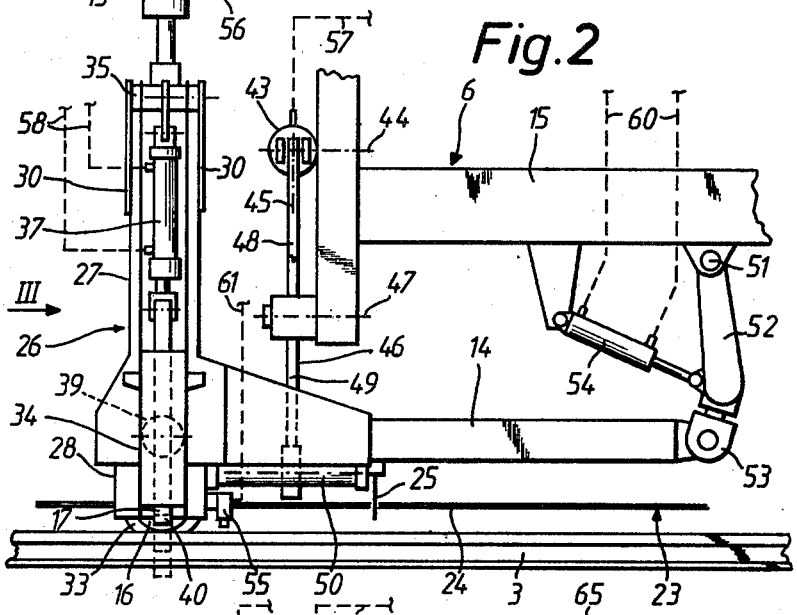
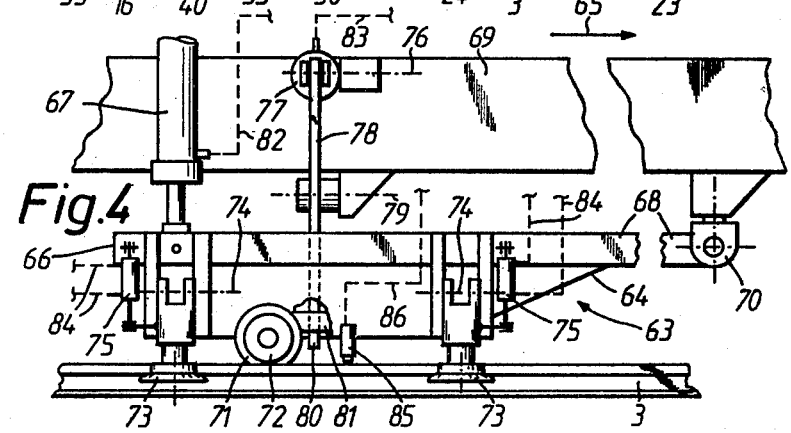
Fig.4

MOBILE TRACK CORRECTION MACHINE

The present invention relates to improvements in a mobile track correction machine mounted for mobility on the rails of the track, and more particularly to a track tamping, leveling and lining machine.

U.S. Pat. No. 3,134,339, dated May 26, 1964, discloses a mobile track tamping and lining machine with a frame having a boom affixed thereto and extending forwardly of the front wheels of the machine frame. The boom carries a track correction apparatus including a U-shaped rail head gripping device arranged to grip each rail head and having a pivotal latch for subtending the rail head at the gage side of each rail. A roller glidingly supports each U-shaped gripping device on the running surface of the rail head. A transverse rod interconnects the two gripping devices and constitutes the piston rods of a double-acting hydraulic jack operable to move in either transverse direction to line the track. The lining cylinder is vertically adjustably mounted on the boom and is connected to the piston rod of a lifting jack mounted centrally on the boom. One of the gripping devices carries a transversely extending sensing element for cooperation with a tension reference wire extending between the machine and a front bogie. The lining cylinder is positioned immediately above the track level, which is advantageous because it assures an almost torsion-free transmission of the lining forces to the track rails. However, heavy track sections, such as switches, cannot be lined with this machine because of the U-shape of the gripping devices and the relatively light construction of the apparatus. German Pat. No. 1,239,343, of Aug. 26, 1971, discloses a mobile track liner whereon a separate lining apparatus in mounted for engagement with each track rail. Each apparatus comprises a lining lever mounted on the machine frame and engageable with the associated track rail by means of two jacks and a guide rod. The structure is not only relatively complex and requires separate lining drives for each apparatus but the arrangement of the guide rods on the machine frame and their relative motions with respect to the track position at the lining point cause considerable problems, particularly in track curves, for the control of the lining operation in relation to a reference system.

The track displacement device in the track tamping, lining and leveling machine of U.S. Pat. No. 3,832,952, dated Sept. 3, 1974, comprises a vertically adjustable tool carrier guided along the track by flanged lining wheels engaging the track rails and carrying lifting hooks staggered from the lining wheels in the direction of machine elongation and arranged for engaging the field sides of the rails. The lifting hooks are guided in horizontal and vertical guides and may be suitably positioned by power drives. Two longitudinally adjustable rods extending in the direction of machine elongation, two vertically extending lifting jacks and two obliquely extending lining jacks extending transversely from the center of the machine frame link the tool carrier to the machine frame. The transmission of the lining and lifting forces is highly disadvanageous in this arrangement. The staggered relationship between the lining wheels and the lifting hooks subjects the interposed rail to unwanted flexing moments which also subject the guides for the hooks and the tool carrier itself to stresses. The angle the lining jacks enclose with the horizontal are similarly disadvantageous because the desired, horizontally extending lining force component is relatively small in relation to the unwanted vertical force component resulting from the operation of the obliquely extending lining jacks. Therefore, these jacks must be oversized to produce the lining force required to displace heavy track sections, such as switches, laterally, and the same holds true for the lifting jacks because their power must compensate for the downwardly directed vertical component of the lining force. This subjects the tool carrier to undue stresses. Furthermore an excessive number of jacks are required and, together with their hydraulic fluid delivery lines, they take up an excessive amount of space and are difficult to service.

It is the primary object of this invention to provide a mobile track correction machine with a simplified track correction apparatus which enables the track to be lifted and, more particularly lined, in a simpler and improved manner.

This and other objects and accomplished according to the invention with a machine which comprises a machine frame, a vertically adjustable tool carrier guided along the track, track lining and lifting tools mounted on the carrier and engageable with the track rails, and power drive means linking the tool carrier to the machine frame. The power drive means includes a lining drive linking the tools carrier to the machine frame and extending substantially vertically above the lining tools and the tool carrier, and a force transmitting lever arrangement extends in a vertical plane and is operable to reciprocate transversely to the track, the lever arrangement connecting the lining drive to the tool carrier. The lever arrangement is preferably comprised of a single connecting member.

This arrangement provides with unexpectedly simple means a track correction apparatus which makes it possible to provide a structurally very favorable and space-saving arrangement of the entire lining drive, inclusive of its hydraulic power lines, on the machine frame immediately above the separate tool carrier while simultaneously assuring the transmission of the lining forces to the adjacent track rails almost free of torsion or any vertical force component. Furthermore, moving the lining drive means for the immediate neighborhood of the tool carrier to an area of the machine frame thereabove, a free space is created which increases the visibility of the adjacent track sectin for the operator and also offers the possibility of guiding a reference wire through this space or therebelow. In addition, instead of using two lining jacks connecting the tool carrier to the machine frame, a single, more powerful jack may be used, thus further reducing the number of structural components. It is another advantage of such a machine that its basic structural concept may be readily adapted to various machine constructions by using different force-transmitting lever arrangements.

The above and other objects, advantages and features of the present invention will become more apparent from the following detailed description of certain now preferred embodiments thereof, taken in conjunction with the somewhat schematic drawing wherein FIG. 1 is a side elevational view of a mobile track tamping, leveling and lining machine incorporating this invention;

FIG. 2 is an enlarged side view of the track correction apparatus of the machine of FIG. 1;

FIG. 4 is similar to FIG. 2 and shows another embodiment of the track correction apparatus according to the invention;

Figure 3:
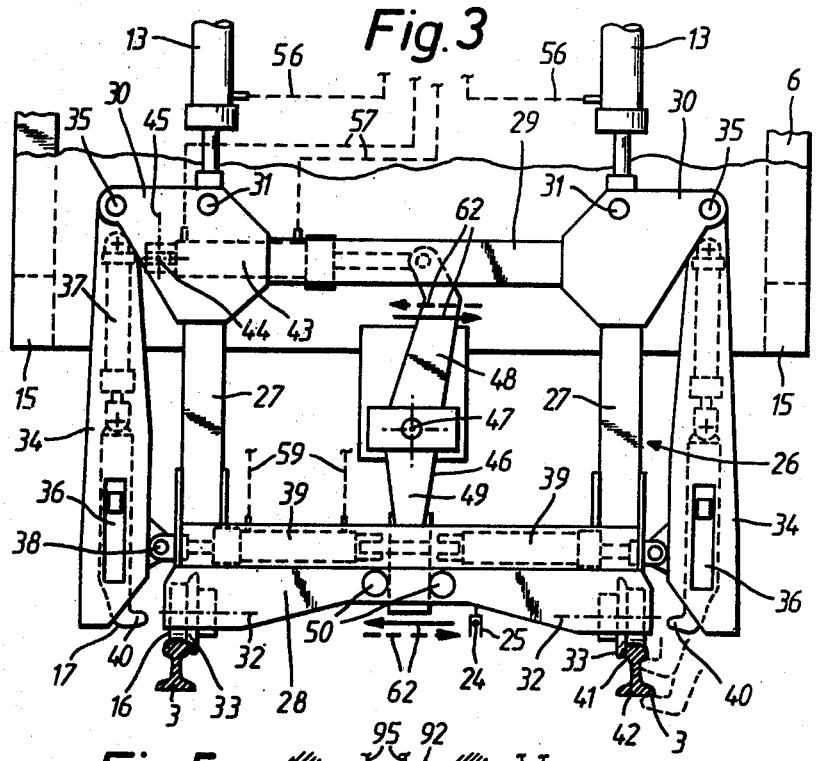
FIG. 3 is a front view of the track correction apparatus, seen in the direction of arrow III of FIG. 2.

Referring now to the drawing and first to FIG. 1, there is shown mobile track correction machine 1 comprising machine frame 6 mounted on swivel trucks 2, 2 for mobility on rails 3 of track 5, the track rails being fastened to ties 4. The machine has drive 7 connected to one of the swivel trucks to move the machine in an operating direction indicated by arrow 8. Machine frame 6 is equipped at respective ends with operator's cabs 9, 9 and has a box-shaped center frame part 10 which holds power plant 11 of the machine.

Track correction apparatus 12 is mounted on the machine rearwardly of central frame part 10, in the operating direction, and is vertically adjustably linked to machine frame 6 by lifting drives 13 which are shown as hydraulic jacks. The illustrated track correction apparatus comprises tool carrier 26 which is a rigid pole undercarriage including pulling member 14 extending substantially centrally between track rails 3 in the direction of the track. The pulling member has a free end and transversely extending horizontal pivot 51 is mounted on elongate carrier beam 15 of machine frame 6. Guide rod 52 links pivot 51 to universal joint 53 and drive 54 connects the guide rod to a bracket on beam 15. The free end of pulling member 14 is linked to the universal joint. Track lining and lifting tools are mounted on carrier 26 and are engageable with the track rails, the lining tools are being shown as flanged wheels 16 engaging the gage side of the track rails and supporting the front of the tool carrier for guiding the carrier along track 5, and lifting and lining hooks 17 facing the flanged wheels whereby the rails are gripped between a flanged wheel and the facing hook, the hooks being arranged to subtend the rail head or rail foot selectively.

Such a tool carrier will automatically align itself radially with its lining and lifting tools when the machine operates in track curves so that the lining forces will be exerted perpendicularly to the rails to improve the lining accuracy.

The illustrated track correction machine if a tamping, leveling and lining machine preferably equipped with tamping units 18 associated with each track rail and capable of operating in tangent track, in track curves and in switch sections. The tamping units are mounted between track correction apparatus 12 and rear undercarriage 2, seen in the operating direction, and hydraulic jacks 19 mount the tamping units vertically adjustably on machine frame 6. Suitable tamping units are well known and are, therefore, not described in detail.

As is also quite conventional and requires no detailed description, machine 1 is equipped with a diagrammatically illustrated reference system 20 comprising a tensioned reference wire whose ends are supported on rail sensing elements 21, 21 which run on rollers on the track rails. Like rail sensing element 22 is arranged between track correction apparatus 12 and tamping units 18 and its upper fork-shaped and cooperates with the tensioned wire to control the lifting operation. Similarly schematically shown lining reference system 23 comprises tensioned reference wire 24 extending below frame 6 and cooperating with sensing elwement 25 to control the lining operation.

One embodiment of the track correction apparatus according to the invention is more fully shown in FIGS. 2 and 3. Tool carrier 26 of this embodiment is comprised of two substantially vertical supports 27 substantially coplanar with track rails 3 and two transverse braces 28, 29 connecting respective ends of the vertial supports. Lower brace 28, vertical supports 27 and upper brace 29 form a rigid rectangular tool carrier frame. The power drive means linking the tool carrier to the machine frame comprises lining drive 43 and a lifting drive comprising two jacks 13, each lifting jack 13 and lifting hooks 34 being linked to tool carrier 26 substantially at respective points of intersection of vertical supports 27 with upper transverse brace 29. Gusset plates 30, which may be welded to the supports and brace, at the points of intersection carry pivots 31 and 35 to which the lower ends of jacks 13 and the upper ends of lifting hooks 34 are respectively linked. Lining drive 43, which links the tool carrier to the machine frame, and extends substantially vertically above the lining tools and the tool carrier, is arranged substantially in the same horizontal plane as upper transverse brace 29. A force-transmitting lever arrangement 48, 49 extends in a vertical plane and is operable to reciprocate transversely to the track about pivot 47 mounted on the machine frame substantially centrally between transverse braces 28 and 29, the lever arrangement connecting lining drive 43 to tool carrier 26.

The tool carrier structure of this embodiment is very rigid and constitutes a structurally and functionally very advantageous for transmitting the lining forces to the track. The illustrated lever arrangement is comprised of a single connecting member constituted by two-armed lever 46 pivotal in the vertical plane about pivot 47, upper lever arm 48 being linked to lining drive 43. This preferred embodiment further comprises entrainment elements 50, 50 constituted by a pair of bolts mounted on the tool carrier and effective in the directions of reciprocation, lower lever arm 49 being received by the entrainment elements for connecting the lever to the carrier. The bolts extend from the tool carrier in the direction of the track and receive an end of lower lever arm 49 therebetween, the bolts defining a slot opening with the tool carrier for receiving the end of the lower lever arm. As shown, the lever arrangement is substantially centered on machine frame 6 between track rails 3.

This lever arrangement is structurally very simple and is robust enough to serve for the transmission of considerable lining forces required, for example, for displacing heavy switch sections laterally. Such a force-transmitting system requires virtually no servicing and functions very dependably. The illustrated entrainment elements glidably connecting the tool carrier to the lever system enables the carrier to be reciprocated for lining without requiring a connecting joint. The use of the two bolts serving as entrainment elements makes it possible readily to displace the tool carrier with respect to the machine frame in the direction of elongation of the machine frame, which is particularly useful during operations in switch sections. Mounting the lever arrangement centrally provides symmetrical movements and force transmission.

Flanged wheels 16 are mounted on stub axles 32 at the respective ends of lower transverse brace 28 for rotation about horizontal axes extending transversely to the machine frame. Flanges 33 of the wheels may be biased against rails 3 of track 5 for clearance-free engagement with the rails by conventional spreading means well known in this art. Lifting tools 34 of track correction apparatus 12 are pivotal in a transverse vertical plane about pivots 35. Lining and lifting hooks 17 are longitudinally adjustably mounted in guides 36 of tools 34 and may be vertically adjusted by jacks 37 so that hook end 40 may selectively subtend head 41 or foot 42 of rail 3. The lower ends of lifting tools 34 are linked at joint 38 to pivoting jacks 39 arranged horizontally on lower transverse brace 28. In the illustrated embodiment, all the power drives are hydraulic jacks. As shown in full and broken lines in FIGS. 2 and 3, operation of jacks 37 and 39 enables hook ends 40 to be engaged selectively with the rail head or rail foot so that the apparatus may be used in switches.

The lining jack 43 is arranged at one side of the machine and its cylinder is linked to machine frame 6 for universal movement about horizontal axis 44 extending in the direction of elongation of the machine frame and vertical axis 45 while its piston rod is linked to the force-transmitting lever arrangement. This lining drive extends parallel to, and substantially at the height of, upper brace 29 and its operation is under the control of lining reference system 23 and sensing element 25 cooperating therewith.

Tool carrier 26 may be repositioned in the direction of track elongation by operation of jack 54 which enables the lining and lifting tools of correction apparatus 12 to remain properly engaged with rails 3 of track 5 in switch sections where track structure components may prevent such engagement or make it difficult. At such a point, tool carrier 26 is displaced until the interfering track structure component is no longer in the way of the track correction tools. To keep two-armed lever 46 in all positions of guide rod 52 in engagement with entrainment elements 50, these elements have a length substantially corresponding to the length of the displacement path of the tool carrier in the direction of elongation of machine frame 6. The end of lower lever arm 49 glides between the entrainment elements during displacement of tool carrier 26 while remaining engaged therebetween.

Safety switch 55 is arranged on tool carrier 26 in association with each track rail 3 close to the lining and lifting tools to monitor the engagement of the rails by these tools. The safety switch is designed to generate a signal if hook 47 is improperly or not engaged with rail head 41 or rail foot 42 and flanged wheel 16 is out of engagement with the rail head. On receipt of this signal, the machine operator is enabled to take suitable countermeasures or such countermeasures may be automatically taken in response to the signal to prevent derailment of tool carrier 26.

Power plant 11 comprises a source of hydraulic fluid connected to lifting drives 13 by conduits 56 and to lining drive 43 by conduits 57, suitable valves being installed in the conduits for controlling the fluid delivery to the cylinders of the drives. Conduits 58 and 59 connect the cylinders of drives 37 and 39 of lifting tools 34 to the hydraulic fluid source and conduits 60 connect the cylinder of drive 54 for tool carrier displacement rod 52 to the hydraulic fluid source, suitable valves being installed in all of the conduits for the control of the fluid flow therethrough. Safety switchs 55 are connected by lines 61 to monitoring and control instruments with which track correction apparatus 12 is equipped.

As indicated by arrows 62 in FIG. 3, the substantially horizontal lining forces generated by lining drive 43 transversely to track 5 are transmitted by reciprocatory two-armed lever 46 engaging entrainment elements 50 to lower transverse brace 28 of tool carrier 26 whence the lining force is transmitted to rails 3 of track 5 by flanges 33 of flanged wheels 16 and hook ends 40 of lining and lifting hooks 17 wherebetween both track rails are securely gripped. This force transmission is effected in a plane extending just above the track level so that lower tool carrier brace 28 is subjected essentially only to pulling or pushing forces and to no significant torsion or bending forces.

FIG. 4 illustrates track correction apparatus 63 designed for operation along normal track sections. In contrast to the above described embodiment intended to be operable also in switch sections, this apparatus has a substantially box-shaped tool carrier 64 and lifting jacks 67 associated with respective track rails 3 are linked to rear end 66, as seen in the operating direction indicated by arrow 65, of tool carrier 64. Pulling member 68 is rigidly connected to the front end of the tool carrier and has a free end linked to machine frame 69 by universal joint 70. Flanged track lining wheels 72 and flanged track lifting rollers 73 are mounted on tool carrier 64, flanges 71 of the lining wheels engaging the gage sides of the rail heads of rails 3 while the flanges of lifting rollers 73 subtend the rail heads at the field sides of the rails. A pair of lifting rollers is associated with each rail and the cooperating flanged lining wheel 72 is mounted between each pair of lifting rollers. The lifting rollers are mounted on the tool carrier for pivoting about horizontal axes 74 extending in the direction of elongation of the machine frame and may be pivoted by drives 75 for engagement with the field sides of the rails. The flanged lining wheel and the lifting rollers cooperate to grip each rail 3 therebetween so that vertical and horizontal lifting and lining forces may be securely transmitted to the track rails.

As in the first-described embodiment, lining drive 77 is linked to machine frame 69 for movement about horizontal axis 76 and actuates two-armed lever 78 which is pivotal about fulcrum 79. Lower end 80 of the lower lever arm is engaged with entrainment elements 80 in a manner similar to that described hereinabove so that the lever will always be connected to the tool carrier during reciprocation transversely to the track. Conduits 82, 83 and 84 connect the cylinders of lifting drives 67, lining drive 77 and pivoting drives 75 to the hydraulic fluid source of the power plant mounted on the machine. Also, safety switches 85 monitor the engagement of lifting rollers 73 with the track rails.

Figure 5:
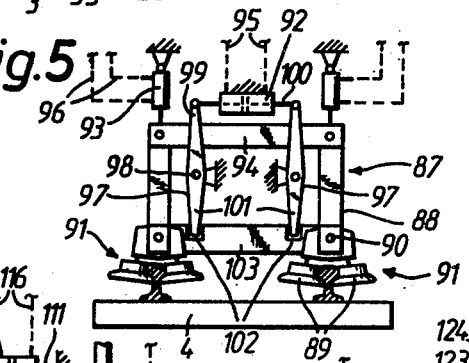
FIGS. 5, 6 and 7 are smaller front views of further embodiments of the track correction apparatus, the lining and lifting tools being illustrated in an exaggerated size relative to the other structural components for the sake of better understanding.

Track correction apparatus 87 shown in FIG. 5 constitutes another embodiment of this invention. Tool carrier 88 is equipped with a pair of gripping rollers 89 arranged to be pivoted about horizontal axis 90 extending in the direction of machine elongation for gripping each track rail therebetween in roller pincer 91 constituting the lining and lifting tools of the apparatus. Lining drive 92 is a double-acting jack extending above the tool carrier parallel to the track and centrally between the track rails. The cylinder of the lining jack is rigidly connected to the machine frame while lifting jacks 93 link upper brace 94 of tool carrier 88 to the machine frame. Conduits 95 and 96 connect the cylinders of jacks 92 and 93 to the hydraulic fluid source of the machine. The force-transmitting lever arrangement for transmitting the lining force from drive 92 to tools 91 and the track rails gripped thereby is comprised of two symmetrically arranged two-armed levers 97 pivotal about a substantially centrally positioned fulcrum 98 mounted on the machine frame and extending in the direction of the track. The upper ends of upper lever arms 99 are linked to the ends of piston rods 100 of double-acting jack 92 while lower lever arms 101 glidably engage in slots 102 of lower brace 103 of tool carrier 88. In substance, the force transmission is effected in the same manner as in the embodiment of FIG. 3.

Figure 6:
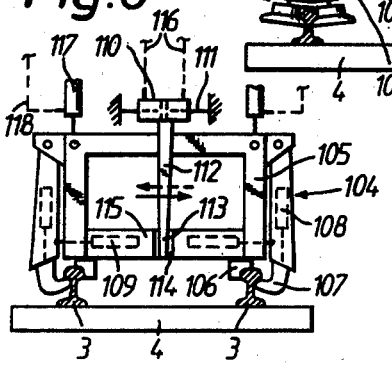

Track correction apparatus 104 illustrated in FIG. 6 is of particularly simple structure. Tool carrier 105 is equipped with gliding shoes 106 for engagement with the gage side of the rail heads and hooks 107 for engaging the field sides of rails 3 so that the rails may be gripped between these lining and lifting tools. In a manner more fully described in connection with the embodiment of FIG. 3, the lifting hooks may be pivoted and vertically adjusted by drives 109 and 108. Double-acting lining drive 110 is comprised of a cylinder mounted to reciprocate transversely to the track on piston rods 111 whose ends are rigidly mounted to the machine frame. Lifting jacks 117 link tool carrier 105 to the machine frame, conduits 116 and 117 connecting the cylinders of drives 110 and 117 to the hydraulic fluid source of the machine. The force-transmitting lever arrangement consists of single connecting member 112 rigidly connected to the cylinder of the lining drive and having a lower end 113 engaged in slot 114 of lower brace 115 of tool carrier 105. In contrast to the previously described embodiments, the lining force is transmitted from lining drive 110 to the tool carrier and the lining tools mounted thereon in the same direction as the lining drive moves.

Figure 7:
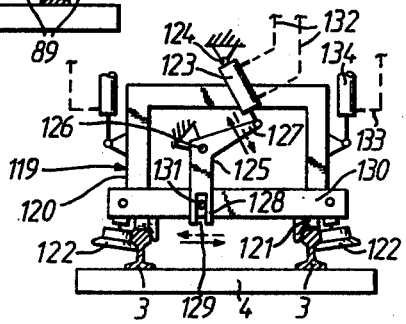

In the embodiment of FIG. 7, track correction apparatus 119 has tool carrier 120 on which there are mounted flanged wheels 117 cooperating with lifting rollers 122 to grip each rail 3 therebetween. Lining drive 123 is mounted essentially above tool carrier 120 on the machine frame, the upper end of the drive being linked to the machine frame by pivot 124 extending horizontally in the direction of machine elongation. The lever arrangement is comprised of bell crank lever 125 whose upper arm 127 extends obliquely towards the lower end of lining drive 123 which is linked to the upper bell crank lever arm, the lining drive extending obliquely between its respective ends linked to the machine frame and the bell crank lever. Fulcrum 126 of the bell crank lever pivots the lever to the machine frame and extends horizontally in the direction of machine elongation, lower bell crank lever arm 128 extending substantially perpendicularly to the track in the illustrated rest position of the lever arrangement. The bell crank lever arrangement enables the lining drive position to be adapted to the available space in particular tool carrier constructions, i.e. the drive may extend in a transverse vertical plane at any desired angle to the horizontal, including even a right angle, while still transmitting an essentially transverse force to the track in a horizontal direction. With the lower lever arm extending perpendicularly to the track in a rest position, the lateral lining force will be transmitted substantially fully to the tool carrier.

The lower end of lower lever arm 128 defines slot 129 glidably receiving entrainment bolt 131 affixed to lower tool carrier brace 130 and extending in the direction of machine elongation. In this manner, the force of obliquely positioned lining drive 123 is transmitted to lining and lifting tools 121, 122 as a horizontally extending, transverse force. The cylinders of lifting drives 134, which link tool carrier 120 to the machine frame, are connected to the hydraulic fluid source by conduits 133 while conduits 132 connect the cylinder of lining drive 123 to this source.

While a number of preferred lever arrangements for transmitting the lining force to the tool carrier have been described and illustrated, those skilled in the art may devise other arrangements functioning in an equivalent manner without departing from the spirit and scope of the present invention as defined in the appended claims. For instance, the upper end of a single-armed force-transmitting lever may be mounted on a high portion of the machine frame and the lining drive mounted above the tool carrier may be linked to this lever. Also, as shown and described, the mounting of the lining drive above the tool carrier means the larger part of the carrier and includes the embodiment wherein the lining drive is actually coplanar with an uppermost part of the carrier. Furthermore, the connection of the lever arrangement to the tool carrier may use a variety of entrainment elements designed to cooperate with the lever arrangement to maintain its connection to the carrier during reciprocation. For instance, if very strong lining forces are to be transmitted to the track, a heavy gliding element may be pivotally mounted on the lower end of the lever for cooperation with a guide bar bracket on the tool carrier.

What is claimed is:

1. A mobile track correction machine mounted for mobility on the rails of the track and comprising (a) a machine frame, (b) a vertically adjustable tool carrier guided along the track, (c) track lining and lifting tools mounted on the carrier and engageable with the track rails, (d) power drive means linking the tool carrier to the machine frame, the power drive means including (1) a lining drive linking the tool carrier to the machine frame and extending substantially vertically above the lining tools and the tool carrier, and (e) a force-transmitting lever arrangement extending in a vertical plane and operable to reciprocate transversely to the track, the lever arrangement connecting the lining drive to the tool carrier and having a lower portion adjacent the tool carrier extending substantially perpendicularly to the track in a rest position of the lever arrangement, the lever arrangement comprising (1) a two-armed lever having a lower lever arm forming the lower portion and (2) entrainment elements mounted on the tool carrier and operable in the directions of reciprocation, the lower lever arm being glidingly received by the entrainment elements for connecting the lever to the carrier.

2. The mobile track correction machine of claim 1, wherein the lever arrangement comprise a single two-armed lever.

3. The mobile track correction machine of claim 1, wherein the two-armed lever is pivotal in the vertical plane about a pivot mounted on the machine frame, an upper lever arm being linked to the lining drive.

4. The mobile track correction machine of claim 1, wherein the entrainment elements are a pair of bolts extending from the tool carrier in the direction of the track and receiving an end of the lower lever arm therebetween.

5. The mobile track correction machine of claim 4, wherein the bolts define a slot opening with the tool carrier for receiving the end of the lower lever arm.

6. The mobile track correction machine of claim 3, 4 or 5, wherein the two-armed lever is a bell crank lever, the upper bell crank lever arm extending obliquely.

7. The mobile track correction machine of claim 1 or 2, wherein the lever arrangement is substantially centered on the machine frame between the track rails.

8. The mobile track correction machine 1, wherein the tool carrier is displaceable relative to the machine frame in the direction of elongation of the machine frame and the entrainment elements have a length substantially corresponding to the length of the displacement path of the tool carrier.

9. The mobile track correction machine of claim 1, wherein the tool carrier is a rigid pole undercarriage including a pulling member extending substantially centrally between the track rails in the direction of the track, the pulling member having a free end, and further comprising a transversely extending horizontal pivot mounted on the machine frame, a universal joint, a guide rod linking the pivot to the universal joint and a drive connected to the guide rod, the free end of the pulling member being linked to the universal joint.

10. The mobile track correction machine of claim 1, wherein the tool carrier is comprised of two substantially vertical supports substantially coplanar with the track rails and an upper and a lower transverse brace connecting respective ends of the vertical supports, the power drive means comprises a lifting drive, the lifting drive and the lifting tools being linked to the carrier substantially at respective points of intersection of the vertical supports with the upper transverse brace, the lining drive is arranged substantially in the same horizontal plane as the upper transverse brace and the lever arrangement has a pivot mounted on the machine frame substantially centrally between the transverse braces.

* * * * *